US011746495B2

(12) United States Patent
Neprud

(10) Patent No.: US 11,746,495 B2
(45) Date of Patent: Sep. 5, 2023

(54) FLOATING FOUNDATION

(71) Applicant: Kevin R. Neprud, Wayland, MA (US)

(72) Inventor: Kevin R. Neprud, Wayland, MA (US)

( * ) Notice: Subject to any disclaimer, the term of this patent is extended or adjusted under 35 U.S.C. 154(b) by 0 days.

(21) Appl. No.: 17/456,089

(22) Filed: Nov. 22, 2021

(65) Prior Publication Data

US 2022/0162827 A1 May 26, 2022

Related U.S. Application Data

(60) Provisional application No. 63/116,260, filed on Nov. 20, 2020.

(51) Int. Cl.

| | |
|---|---|
| ***E02D 27/06*** | (2006.01) |
| ***E02D 35/00*** | (2006.01) |
| ***E04H 9/14*** | (2006.01) |
| ***B63B 21/50*** | (2006.01) |
| ***E02B 17/08*** | (2006.01) |
| ***E02D 29/14*** | (2006.01) |
| ***E02D 29/12*** | (2006.01) |

(52) U.S. Cl.

CPC ..... *E02D 35/005* (2013.01); *B63B 21/507* (2013.01); *E02B 17/0809* (2013.01); *E02D 27/06* (2013.01); *E02D 29/124* (2013.01); *E02D 29/1409* (2013.01); *E04H 9/145* (2013.01)

(58) Field of Classification Search

CPC ..... E02D 27/06; E02D 27/30; E02D 27/32; E02D 35/00; E02D 35/005; E04H 9/145

See application file for complete search history.

(56) References Cited

U.S. PATENT DOCUMENTS

| | | | | |
|---|---|---|---|---|
| 2,715,756 A * | 8/1955 | Carver | E04H 9/145 52/274 |
| 3,986,367 A * | 10/1976 | Kalpins | E02D 27/34 376/285 |
| 5,647,693 A * | 7/1997 | Carlinsky | E02D 5/00 52/169.9 |
| 5,775,847 A * | 7/1998 | Carlinsky | E02D 27/32 52/169.9 |

(Continued)

FOREIGN PATENT DOCUMENTS

| | | | |
|---|---|---|---|
| CN | 108442398 A * | 8/2018 | |
| EP | 1033446 A1 * | 9/2000 | E02D 15/08 |

(Continued)

OTHER PUBLICATIONS

International Search Report and Written Opinion from related International Application PCT/US21/72553, filed Nov. 22, 2021.

*Primary Examiner* — Frederick L Lagman

(74) *Attorney, Agent, or Firm* — Grossman, Tucker, Perreault & Pfleger, PLLC

(57) ABSTRACT

A lift system and method for supporting a structure. The lift system includes a first buoyant sponson tank comprising a sponson tank that extends from a first end to a second end, a mechanical assembly extending from the second end of the sponson tank, the mechanical assembly to transfer a load of a structure disposed on the mechanical assembly to the sponson tank. The sponson tank is configured to be displaced by a volume of fluid that is external to the tank and the tank provides a predetermined buoyant force against the structure to cause the structure to be displaced vertically.

15 Claims, 18 Drawing Sheets

(56) References Cited

U.S. PATENT DOCUMENTS

| | | | | | |
|---|---|---|---|---|---|
| 5,904,446 | A * | 5/1999 | Carlinsky | E02D 27/32 | 52/169.9 |
| 6,347,487 | B1 * | 2/2002 | Davis | E04H 9/145 | 52/64 |
| 8,777,519 | B1 * | 7/2014 | Henderson | E04H 9/0235 | 52/167.1 |
| 2004/0169376 | A1 | 9/2004 | Ruer | | |
| 2004/0261338 | A1 * | 12/2004 | De Cherance | E02D 27/36 | 52/292 |
| 2011/0061321 | A1 | 3/2011 | Phuly | | |
| 2011/0123275 | A1 * | 5/2011 | Nelson | B63B 35/44 | 405/195.1 |
| 2018/0100281 | A1 | 4/2018 | Nottingham | | |

FOREIGN PATENT DOCUMENTS

| | | | | | |
|---|---|---|---|---|---|
| EP | 3015626 | A1 * | 5/2016 | E04H 9/145 | |
| GB | 2499011 | A * | 8/2013 | B63B 35/44 | |
| WO | WO-03031732 | A1 * | 4/2003 | E02D 27/06 | |
| WO | WO-2006104175 | A1 * | 10/2006 | E04H 9/145 | |

* cited by examiner

| System Size | Bore Hole Diameter (Feet) | Tank Diameter (Feet) | Tank Height (Feet) | Tank Cubic Foot Volume | Displacement with 64 lbs/ft$^3$ Sea Water Weight | Number of Units Installed | Total Displacement/ Bearing Weight | Total Tons Displacement/ Bearing Weight (lb Weight/2000) |
|---|---|---|---|---|---|---|---|---|
| 1 | 2 | 1.6 | 40 | 80.38 | 5,144.58 | 4 | 20,578.30 | 10.29 |
| 2 | 2.5 | 2 | 40 | 125.60 | 8,038.40 | 4 | 32,153.60 | 16.08 |
| 3 | 5.5 | 4 | 40 | 512.40 | 32,153.60 | 4 | 128,614.40 | 64.31 |
| 4 | 7.5 | 6 | 40 | 1,130.40 | 72,345.60 | 4 | 280,382.40 | 144.60 |
| 5 | 10 | 8 | 40 | 2,009.60 | 128,614.40 | 4 | 514,437.60 | 257.23 |
| 6 | 12.5 | 10 | 40 | 3,140.00 | 200,960.00 | 4 | 808,840.00 | 401.92 |
| 7 | 15 | 12 | 40 | 4,521.60 | 289,382.40 | 4 | 1,157,529.60 | 578.76 |

FIG. 12

FLOATING FOUNDATION

CROSS-REFERENCE TO RELATED APPLICATIONS

This application claims the benefit of U.S. Provisional Patent Application Ser. No. 63/116,260, filed Nov. 20, 2020, which is fully incorporated herein by reference.

TECHNICAL FIELD

This specification relates generally to foundations for supporting structures, and in particular, to a lift system for both supporting a structure potentially to the same level as a permanent fixed foundation and allowing the same to "float" in the event of storm surge or other events that cause water levels around the structure to rise.

BACKGROUND INFORMATION

The following is not an admission that anything discussed below is part of the prior art or part of the common general knowledge of a person skilled in the art.

It is anticipated by 2050 approximately 70% of the world's population will live in urbanized areas. 90% of the world's largest cities are situated on the waterfront where they are exposed to rising sea levels, coastal storms and/or tsunamis. Hurricane Dorian in September of 2019 generated a 23 foot (7.5M) high storm surge that swept over Grand Bahama Island. The 2011 Fukushima Tsunami that hit Japan caused the tallest wave to make landfall to reach 33.5 feet (10M) in height due to the unique topography of the seafloor and coastland. About 250 miles (400 km) of Japan's northern Honshu coastline dropped by 2 feet (0.6 meters), according to the U.S. Geological Survey.

In 1938, a hurricane killed about 600 people in southern New England. The storm hit Rhode Island as a category 3 and produced a storm surge around 15 feet at the mouth of Narragansett Bay which pushed a 20 foot storm tide into downtown Providence. In 1954 Hurricane Carol flooded downtown Providence with 12-14 feet of water. Many cities and municipalities on the East coast of the US such as Miami, New York City, Norfolk, VA and Charleston, SC are highly vulnerable to storms like the 1938, 1954 Hurricanes or the September 2019 Hurricane that inundated Grand Bahama Island.

There exists a need for a foundation that can support a structure and allow the same to "float" in the event of storm surge or other events that cause water levels around the structure to rise.

BRIEF DESCRIPTION OF THE DRAWINGS

The drawings included herewith are for illustrating various examples of articles, methods, and apparatuses of the teaching of the present specification and are not intended to limit the scope of what is taught in any way.

FIG. 12 includes Table 1 showing various examples of system size configurations and corresponding characteristics to provide a general understanding of the range of solutions the system can provide. The table does not outline the full capabilities, the system is capable of achieving greater and lesser performance than included in the table.

FIG. 16 is a 3D aerial view that demonstrates how the roof of the building 134 can camouflage the structure so it blends in with its surroundings.

DETAILED DESCRIPTION

Figure 1:
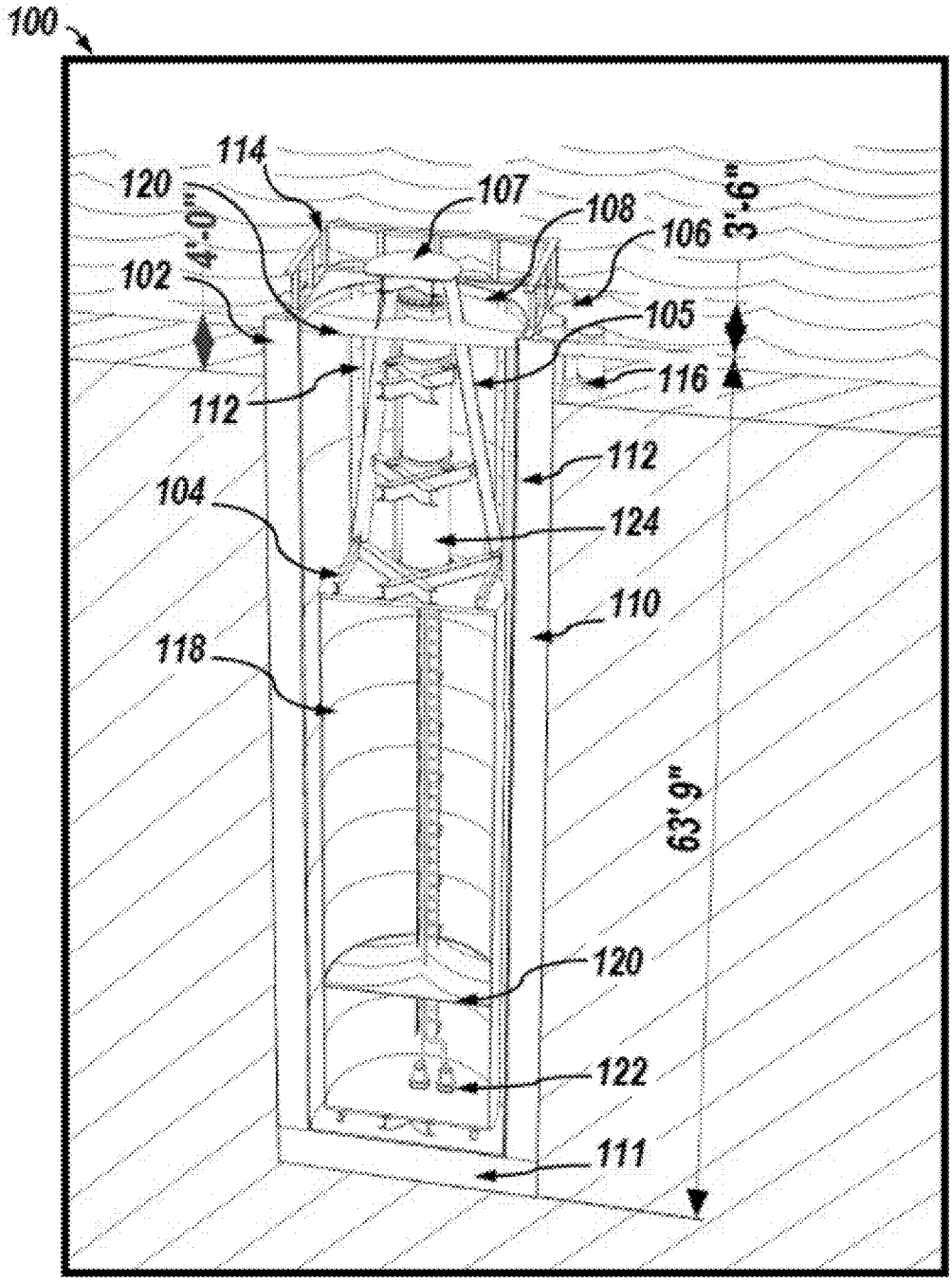
FIG. 1 shows an example lift system for supporting a structure, in accordance with an embodiment of the present disclosure that is floating while the lift system is submerged in the water along a coastline, river or any body of water.

As discussed above, there exists a need for a foundation (also referred to herein as a Floating Foundation (FF) or Adjustable Height-Floating Foundation (AH-FF), or floating foundation pile (FFP) or amphibious foundation system (AFS) structure lift system or simply a lift system) that can anchor and support a structure potentially to the same levels of anchoring and support that categorize the system as being comparable to conventional fixed concrete foundations that utilize subgrade piles or subgrade concrete walls and spread footings to transfer all loads into the ground via exterior vertical and horizontal surfaces and allow the same to "float" in the event of storm surge or other events that cause water levels around a structure to rise. More specifically, aspects and features of a lift system consistent with the present disclosure are particularly well suited for fixed structures on water or land such as single and multi-family homes, commercial, institutional or infrastructure facilities, including military, coastguard, search and rescue, law enforcement and fire stations, boathouses, docks and piers that may be disposed in a geographic location prone to flooding and/or rising water levels due to natural tide cycles, storms, climate change or man-made events such as a dam or levee break. If the variable height foundation system is accepted by industry as being a foundation with comparable properties to fixed, permanent foundations such as it could allow structures utilizing the system to be considered permanent structures. Permanent structure status could avail mortgage financing, tax, insurance and other benefits for example, as compared to a single family residence that is considered a houseboat or mobile home. It is contemplated that if the system gains acceptance with the appropriate authorities that it could be established by authorities as a preferable alternative to conventional fixed foundations and enable greater financing, tax and insurance benefits as well as improve property values beyond any other foundation type including stilts, pilings and piers commonly used in flood prone areas. The system essentially floodproofs the structures it supports potentially eliminating the need for flood insurance.

Preferably, the lift system provides unprecedented resilient protection from extreme disasters such as the 33' tall tsunamis that struck the Honshu coast of Japan or from Hurricanes like Dorian that generated 160 mph winds with 10+' seas on top of a 23' high storm surge that swept over the Bahamas in 2019.

Preferably, the lift system is fully automated and failsafe such that the lift system operates with a failure rate of less than 0.01% and requires no human input to be fully functioning so a structure is protected when an evacuation is ordered.

Preferably, the lift system is a net zero energy system, wherein the total amount of energy used by the lift system on an annual basis is equal to the amount of renewable energy created on the site. More preferably, the lift system can operate without power in a passive manner. Thus, a lift system in accordance with the present disclosure can function in relatively remote areas or when power is unavailable due to storm damage and other such scenarios.

Preferably, the lift system is easily mass-produced using off-the-shelf components and be modular and scalable. This disclosure recognizes that affordability is an important factor to implementing the lift system at scale across many market sectors.

Preferably, the lift system is capable of very heavy load carrying, e.g., up to 578.76 tons as shown in FIG. 1, or if made in larger sizes or used in greater numbers, the structure it protects is not weight restricted and can be made using affordable materials and methods.

Preferably, the necessity of exposed boat hulls underneath a structure is eliminated by the lift system to save cost, complexity and potential failure if hulls are damaged by floating surface debris. Keeping the means of buoyancy in the system well below the water surface, reduces or eliminates wave motion in the system and structure the system supports.

Preferably, the lift system should not impose restrictions on the floor plan or exterior envelope of the structure. Preferably, the lift system should be substantially obscured from view, and more preferably completely obscured from view, from the interior and exterior of the supported structure. Also, no prime space inside or outside the building should be required for the lift system.

Preferably, for accessibility, the first floor/deck of a structure supported by a lift system consistent with the present disclosure should be able to lower to less than 2 feet above the current water level or for search and rescue, fire or Coastguard type facilities or boathouses be able to lower and submerge boat ramps, storage decks, docks or piers and berthing cradles for watercraft as well as amphibious vehicle storage and launching platforms or ramps.

In view of the foregoing, aspects of the present disclosure aim to create a mechanically simple, reliable, fast acting, mostly passive, fully automated lift system that can rise quickly to match changing water levels and sea surface conditions through the following non-limiting list of features:

Use of one or a plurality of buoyant sponson tanks) positioned below the water surface to passively lift a supported structure without necessarily relying on mechanical equipment or off-site power that might not be functioning during a storm.

Position one or a plurality of buoyant sponson tanks below the water surface or below the ground or sea floor to eliminate wave motion in the structure above.

House buoyant sponson tanks in a bore well (also referred to herein as a sponson well, or simply a well) that is about 50 to 120 feet (15 to 36 meters) deep, 3 ATMs (303 kPa) of atmospheric pressure. Although positioning the buoyant sponson tanks at deeper water depths will not increase lifting capacity unless the volume of the sponson is increased, the atmospheric pressure increase will require the sponson to have stronger walls at the bottom.

The buoyant sponson tanks preferably include a cylindrical shape which has a cross-sectional profile well suited to resist the force of water pressure. These properties can be further enhanced by having a half-spherical or hemispherical shaped bottom.

Preferably, buoyant sponson tanks get anchored sufficiently to bore well foundation walls via a sliding track system or other suitable mechanical approach of height adjusting anchorage that allow each buoyant sponson tank to slide up and down freely and provide ample lateral support to potentially resist up to Category 5 force winds and waves during the largest storm surge and wave height event with the highest winds. One such example depth for a sponson well is at least 60 feet in depth and with current well known construction means, methods and materials be as deep as 120 feet and be relatively affordable to construct.

One aspect of the present disclosure includes establishing the amount of overlap length between a buoyant sponson tank and the bore hole wall at the system's maximum lift height in order to determine maximum lateral structural loading. See Table 1 below for non-limiting example system configurations. Wells can be constructed deep enough so that at the fully extended height, the entire sponson could remain completely concealed within the well to maximize the overlap to create relatively high levels of lateral support and protect the sponson from exposure to water current and debris entrained in the water that for example, could be encountered in a fast flowing river or in heavily wooded or urban areas where large amounts of sizable debris could dislodge and strike the system at high velocity.

Protection against these extreme debris field conditions can also be increased by adding open mesh type deflection screening to the system's upper superstructure referred to herein as the exoskeleton superstructure 105, located above the sponson, that water and small size debris that does not pose a threat to the system could flow through to reduce debris buildup on the structure and hydrodynamic drag but does not allow passage of debris of a size that could damage the system. Looking downward from above, in plan view, a system 100 utilizing 3 or 4 tank exoskeleton superstructures 105 between the sponson tank and the top mounting plate of the system, can be oriented so that one of the exoskeleton superstructures 105 face directly upstream toward the direction of water flow.

In this orientation, the mesh between this tank and the two tanks downstream in the water flow would be at approximately 45 degrees to the direction of water flow to help redirect debris and reduce the impact force of debris on the system. Configuring multiple floating foundation lifts 100 in a vee or diamond arrangement in plan view, with the system 100 that is located at the point of the vee/diamond pattern facing upstream, toward the direction of flow could further reduce the potential of debris damaging or collecting against the system.

An aspect of the system can include providing stops or bumpers at both ends of the track(s) 112 to keep the buoyant sponson tank 104 from dropping lower than a predetermined low point and toward the top or at the top of the tracks where they terminate at the top of the well 102 to prevent the buoyant sponson tank 104 from being lifted up and out of the well 102 by high water levels or uplifting wind forces that exceed the respective predetermined design tolerances.

Tsunamis strike with little or no warning so the diameter of the bore well is preferably sized to be sufficiently larger in diameter than the diameter of an associated buoyant sponson tank so that water can fill under the buoyant sponson tank sponson at a rate which is fast enough to lift at a rate that keeps the lowest floor level of the supported structure above the crest of the tsunami/water.

Figure 7:
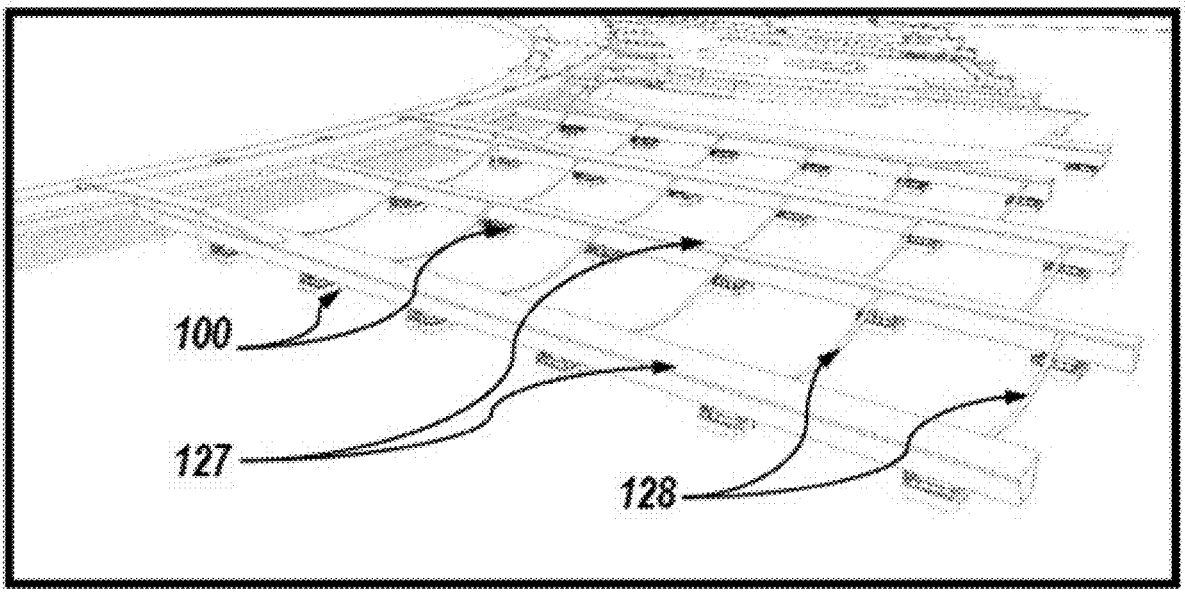
FIG. 7 shows an Adjustable Height Floating Foundation pier 127 or dry dock in accordance with an embodiment of the present disclosure that are lifted with one or more lift systems 100. Lifting slings or straps 128 or other means to secure watercraft to lifting docks or piers 127 on two or more sided of the watercraft. Vessels are lifted out of the water by simultaneously raising the lifting piers 127 on two or more sides of the watercraft. It is also possible to submerge the lifting dock or pier 127 or a number of them to float watercraft or subsurface craft over lifting docks or piers 127 and lift the vessels with or without lifting slings 128 or cradles.

The system 100 can be used to lift a watercraft or multiple watercraft of virtually any size including vessels and ships if configured as an Adjustable Height Floating Foundation pier 127 or dry dock, as shown in FIG. 7. Lifting docks or piers 127 in FIG. 7 with lift systems 100 on one or more sides of a watercraft can lift vessels out of the water. This can be accomplished by placing any number of adjustable length lifting slings 128, spanning between two parallel lifting docks 127, as are necessary to carry and distribute the weight of a vessel being lifted. With this configuration, by simultaneously raising the lifting piers 127 on two or more sides of a watercraft or multiple crafts in a row, with 6 lift systems per pier (12 total) could preferably lift 3,472 tons or a 3,000 Ton yacht, ship, submarine or other watercraft or multiple watercrafts. Other means to secure watercraft to lifting docks or piers 127 other than lifting slings or straps 128 can also be used. It is also possible to add ballast water inside the sponson tanks in the amount necessary to submerge the lifting dock or pier 127 or a number of them deep enough underwater for watercraft or subsurface craft of any size to float over and stop above the lifting docks or piers 127. Then lift the vessels completely out of and above the water with or without lifting slings 128 or with or without cradles by raising the lift systems 100 simultaneously by discharging ballast water from within each of the sponson tanks.

Figure 2:
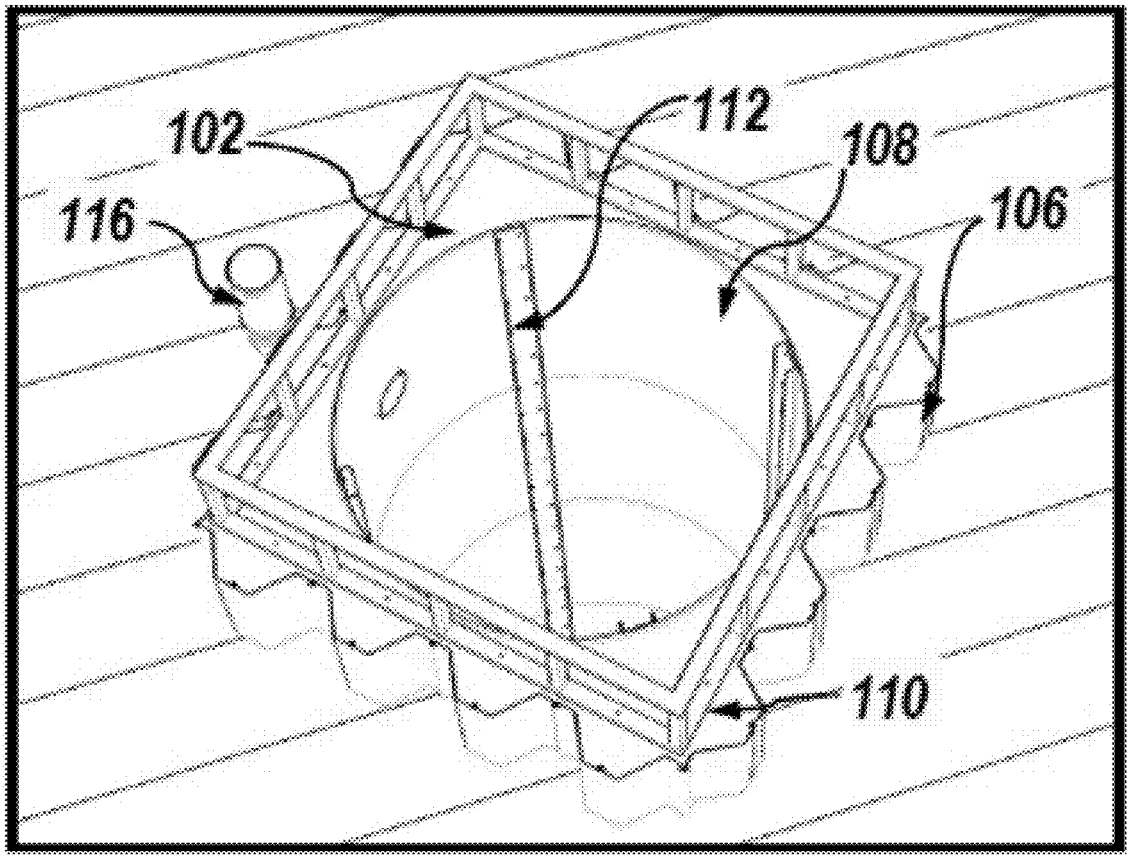
FIG. 2 shows a sponson well suitable for use within the lift system of FIG. 1, in accordance with an embodiment of the present disclosure.
Figure 3:
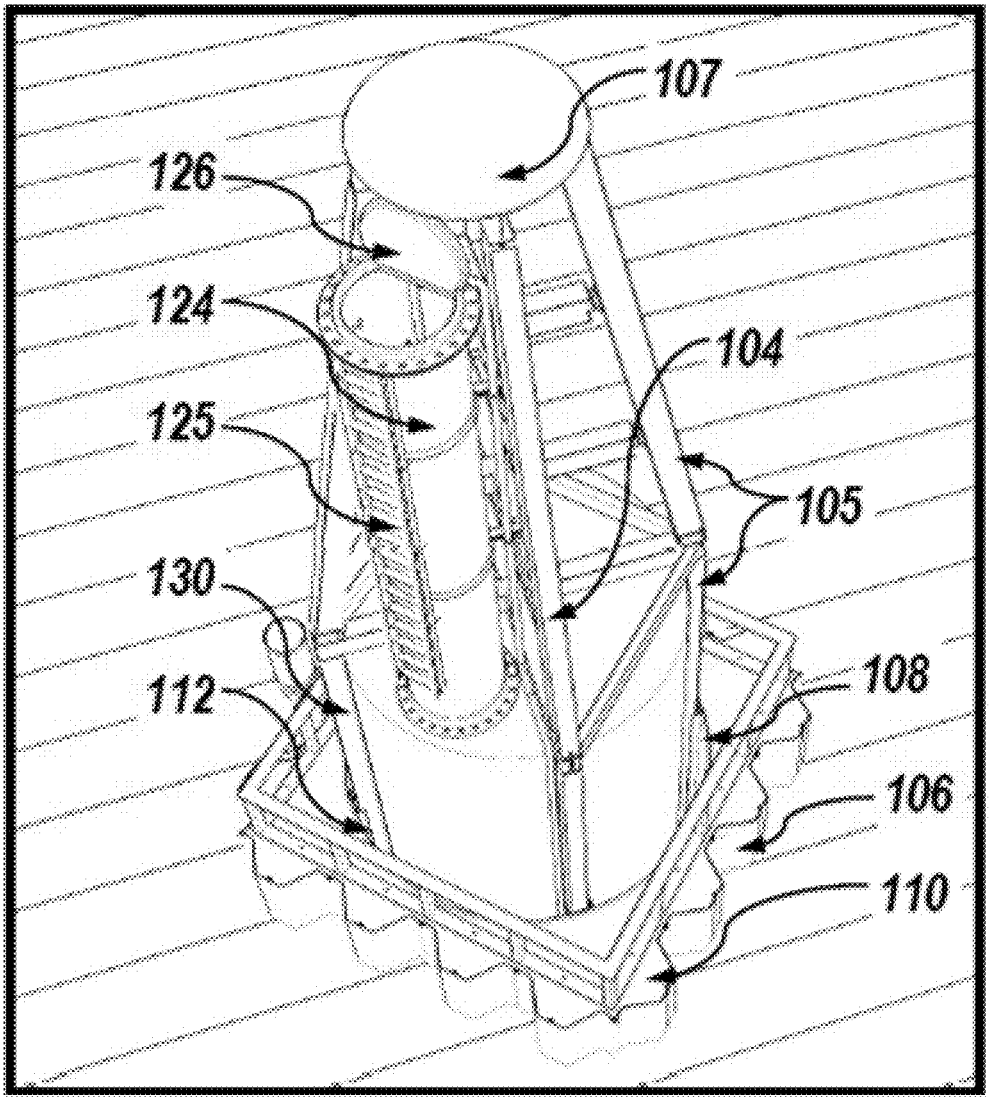
FIG. 3 shows a buoyant sponson tank disposed within the sponson well of FIG. 2, in accordance with an embodiment of the present disclosure.

Referring to FIGS. 1-3, FIG. 1 shows a cross-sectional view of an example lift system 100 for supporting a structure (not shown) in accordance with an embodiment of the present disclosure.

The lift system 100 includes at least one buoyant sponson tank 104, which may preferably be in the form of a cylinder or column, disposed in a sponson well 102.

The sponson well 102 preferably includes a bore that extends below ground. Preferably, the bore of the sponson well 102 extends along a longitudinal axis that extends substantially perpendicular relative to the potential water surface above the system and ideally the surface of the area surrounding the top-side opening of the sponson well 102 although this surface does not have to be level.

The bore of the sponson well 102 can extend below the ground between 20 and 120 feet, for example, depending on a desired configuration. Although the system can be deeper than 120 feet, the construction of the well becomes significantly more complicated and costly and the increased water pressure requires a significantly stronger more costly sponson tank or lower tank(s) in multi-sponson systems that have chambered or multiple upper and lower tanks. Multi-chambered tanks with watertight bulkheads or having two or more sponson tanks in a single well, minimizes the degradation of performance if a sponson rupture occurs.

Although other cross-sectional shapes are possible, the bore of the sponson well 102 is preferably substantially cylindrical and includes a predetermined width. In scenarios where the bore of the sponson well 102 is cylindrical, such as shown in FIG. 1, the predetermined width can include a diameter of between 2 to 30 feet, and preferably between 2 and 16 feet to utilized readily available materials and systems that are easily transported to the site by roadways. Systems can exceed 30 feet in diameter, and may be referred to herein as pad or slab type floating foundations or a hideaway or hideaway system. Any of the floating foundation systems no matter what diameter or depth can be designed to retract the structure or object they support to a depth that is partially or fully below the top rim of the bore well or ground elevation outside the well.

The bore of the sponson well 102 is preferably configured to receive a single buoyant sponson tank, such as the buoyant sponson tank 104 as shown in FIG. 1. Note, one preferred example includes the lift system 100 having at least two or more buoyant sponson tanks and associated sponson wells. The at least two buoyant sponson tanks and associated sponson wells are preferably configured substantially the same, and more preferably, are configured to supply a substantially equal amount of buoyant force to a supported structure when bores of the same include a substantially equal amount of fluid, e.g., sea water, storm water, etc. Note, another preferred example includes a single lift system 100 having a diameter of at least 30 feet to increase lift force or where a shallow well depth is preferred to create an equal lift force as a smaller diameter deeper well can.

Figure 8:
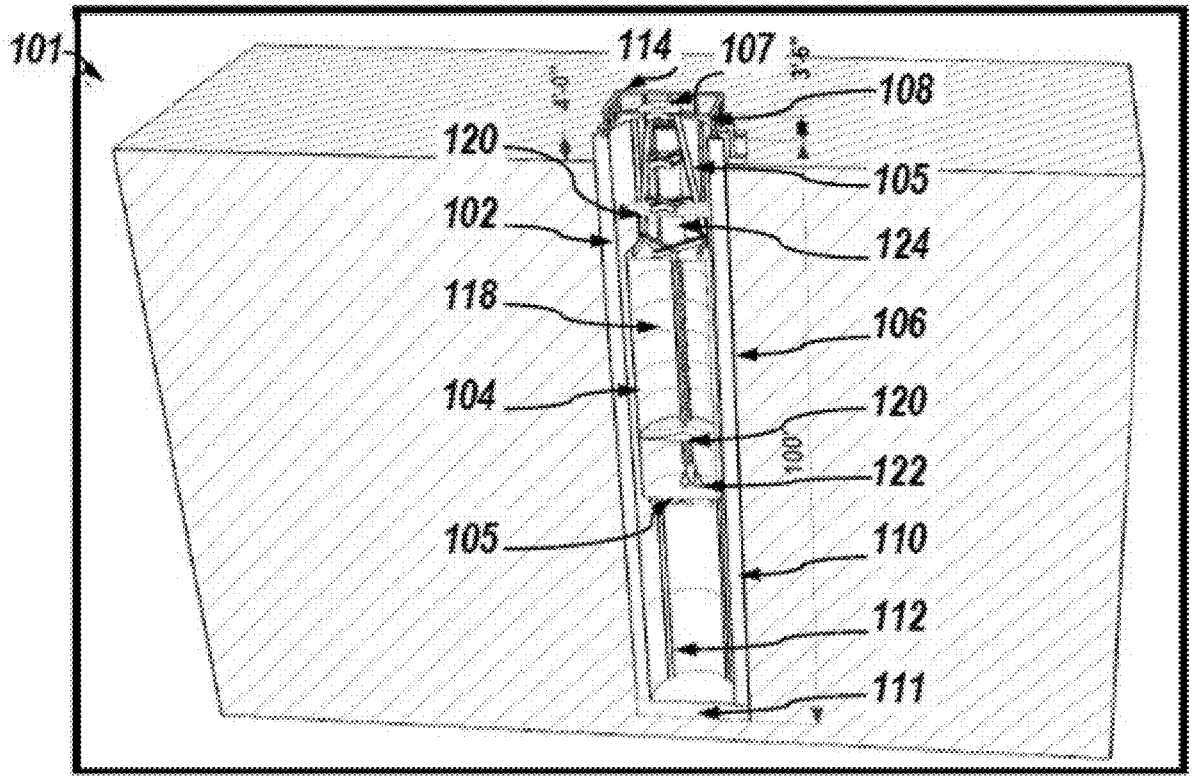
FIG. 8 shows an example of the lift system for supporting and lifting a structure, in accordance with an embodiment of the present disclosure where the system is located out of the water body on upland. A buoyant sponson tank disposed within a sponson well of FIG. 8 that is deeper than the sponson well 102 of FIG. 4 to contain enough water to displace the total weight the lift system and structure it supports.

FIG. 8 Shows an example lift system for supporting a structure, in accordance with an embodiment of the present disclosure that is located on land that is occasionally above the height of surface water or what is commonly referred to as being on upland or dryland. The same buoyant sponson tank included in FIG. 2 and FIGS. 4-6 is disposed within a sponson well of FIG. 8 of greater depth than the sponson well depicted in FIG. 2 and FIGS. 4-6. The well depth is increased to a depth necessary to maintain enough water under the sponson when the system is in its lowest height position and no surface water is present on the land adjacent to the system, to displace and float the weight of the system including ballast water 120 in the sponson tank and the structure it supports along with a reasonable ballast weight margin for load balancing when surface water is not present to float and lift the system.

Before surface water reaches the system, the amount of ballast water in the sponson is designed so that when discharged via pump, syphon action or other means, the system will lift the structure it supports to a predetermined height to compensate for anticipated or forecasted wind, water current or atmospheric pressure driven surface waves that might accompany flooding during ocean storm surges or river flooding events or compensate for fast moving surges of water caused by Tsunamis, dam or levee failures, etc. The depth of the sponson well may also be constructed deep enough to contain the ballast water discharged from the sponson tank and retain the additional water within the confines of the sponson well to increase lifting capacity of the system. Containing the ballast water within the system allows the structure to be raised and lowered multiple times without having to add water from an external source to the system when additional ballast is needed.

Accordingly, while ballast water is a preferred ballast medium, other ballast mediums may be utilized, such as liquids that are denser or heavier than water to decrease the size of tanks and wells, to decrease lift or be discharged from inside the sponson tank to increase lift. In other words, the ballast within the sponson tank may be adjusted to increase or decrease the buoyant force the sponson tank may provide against the structure to be lifted and vertically displaced. The ballasting can be used to balance multiple lift systems that are being used together in a synchronized manner to adjust for dead of live load changes, to counteract external forces acting on the system or the payload structure the system lifts and lowers. These forces can also include water currents, surface waves, wind, seismic and other naturally occurring or man-made sources.

Figure 9:
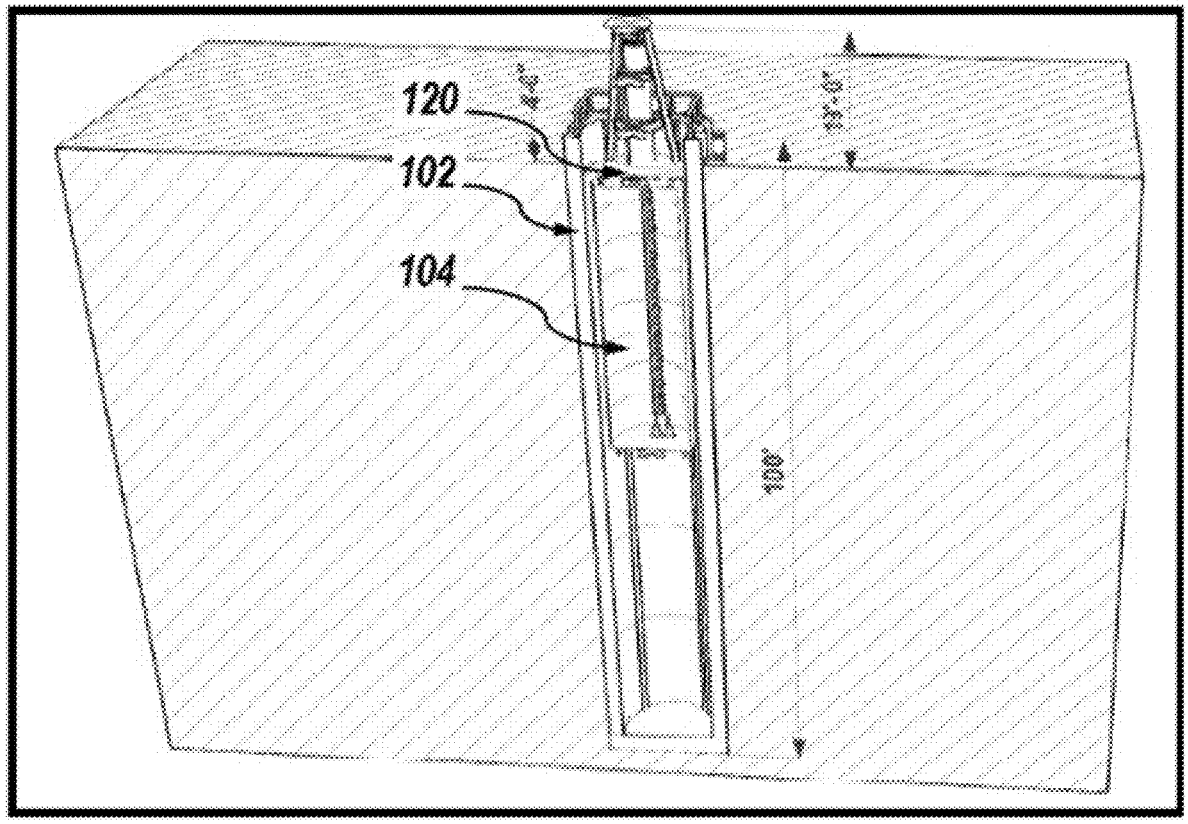
FIG. 9 shows the buoyant sponson tank extending from within the sponson well of FIG. 2 to supply a buoyant force against a supported structure based on discharging ballast water 120 (shown in FIG. 8) from within the sponson tank 104, in accordance with an embodiment of the present disclosure.
Figure 15:
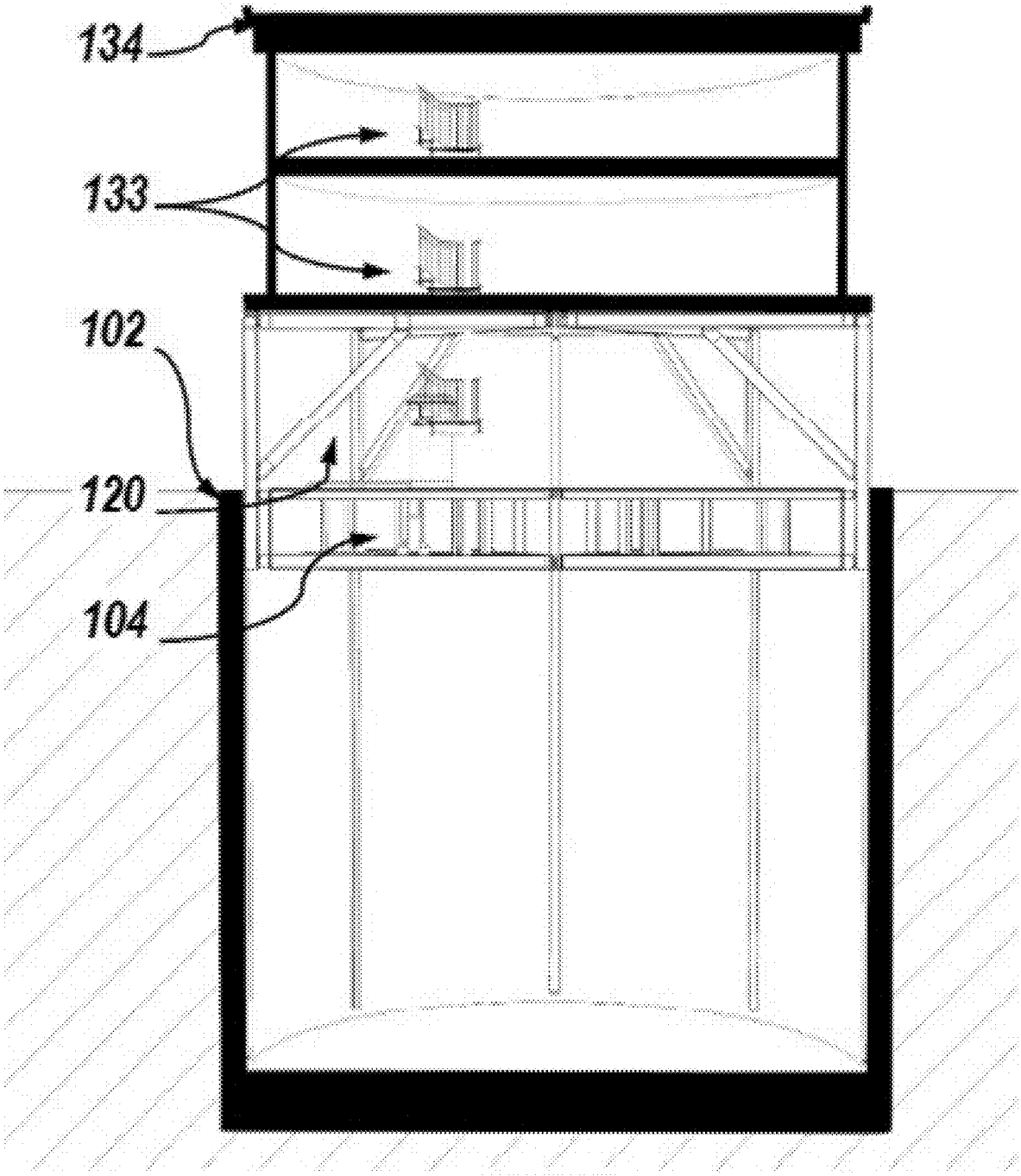
FIG. 15 shows the same facility depicted in FIG. 14 when the building is lifted during a flood with the water level 120 about 5 feet higher than finished grade.
Figure 16:
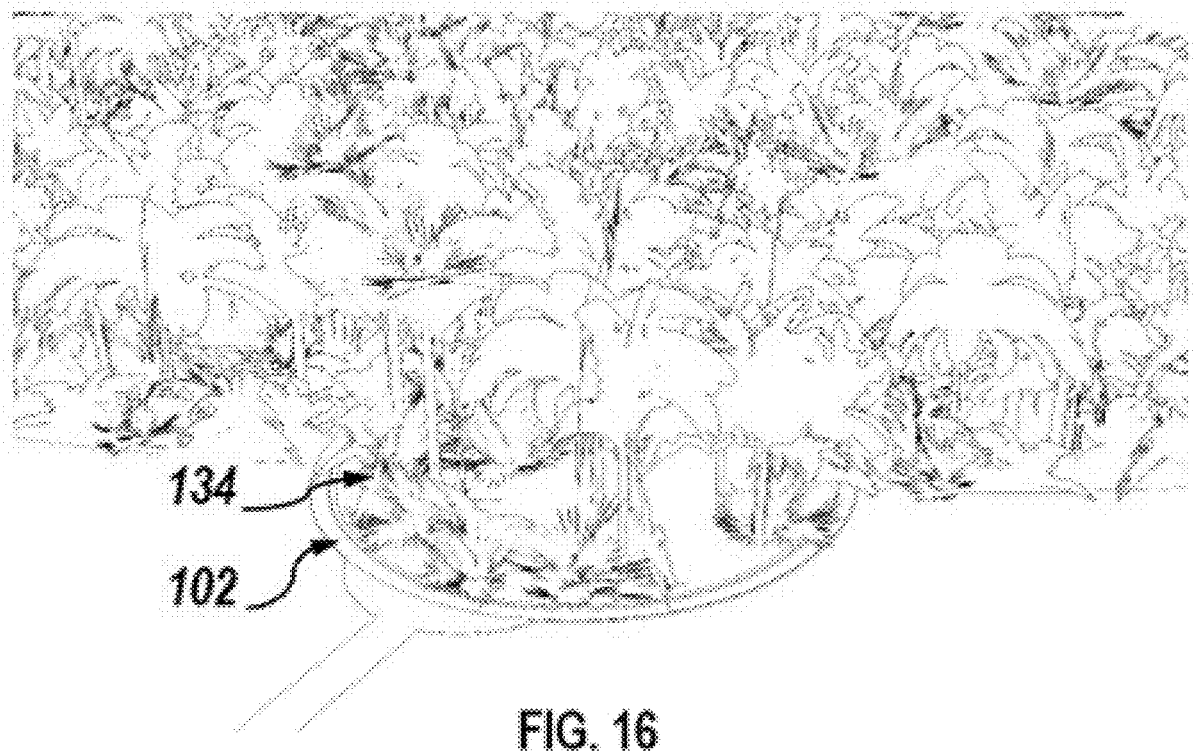
FIG. 16 shows the same building and lifting pad foundation system shown in FIG. 13 that is in accordance with an embodiment of the present disclosure and in the same disposition with the two-story building retracted or lowered to stow below finished grade height within the sponson well 102.
Figure 17:
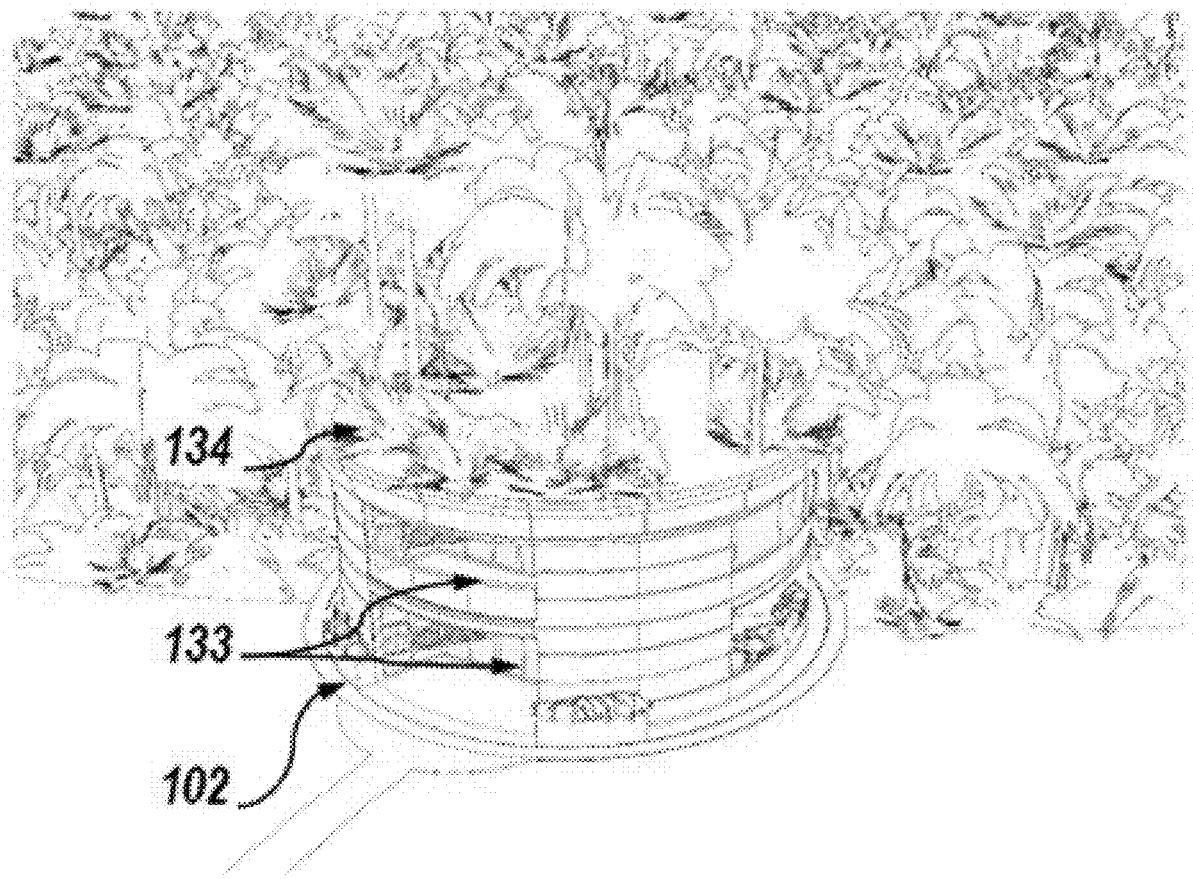
FIG. 17 shows the same building and lifting pad system with the first floor level floor of the two-story building 134 aligning with finish grade which is the same building height configuration as FIG. 14
Figure 18:
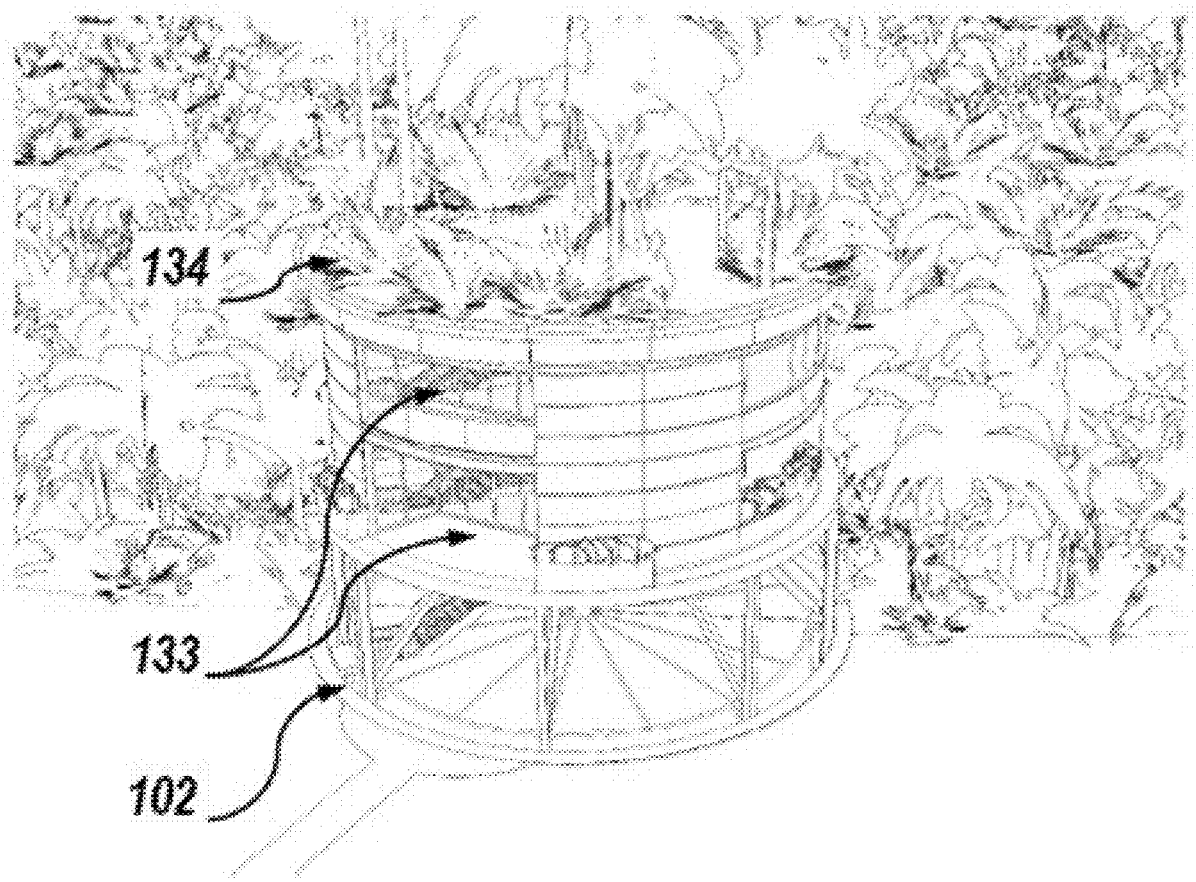
FIG. 18 shows the same building and lifting pad system with the first floor level floor of the two-story building 134 raised more than one story above finish grade in preparation for or during a flood which is the same building height configuration as shown in FIG. 15.

FIG. 9 shows one example of the buoyant sponson tank of the lift system after the ballast water included in FIG. 8 is discharged via a water pump, well pump or more than one pump located in the bottom of the sponson tank as shown in the FIGS. 1, 4-6 and 8-9, or located elsewhere. In FIG. 9, this discharge preferably raises the system from 3'-6" above the top of the sponson well structure or 7'-6" above grade as shown in FIG. 8, to 15'-0" above the top of the well and 19'-0" above the adjacent site grade. The amount of ballast water discharge lift can be designed or adjusted to be any portion of the systems total lifting height capability. For example, the water ballast system can be designed to lift structures to a height that preferably matches the required height of buildings nearby that are built on top of stilts as a means to protect against flooding.

Figure 10:
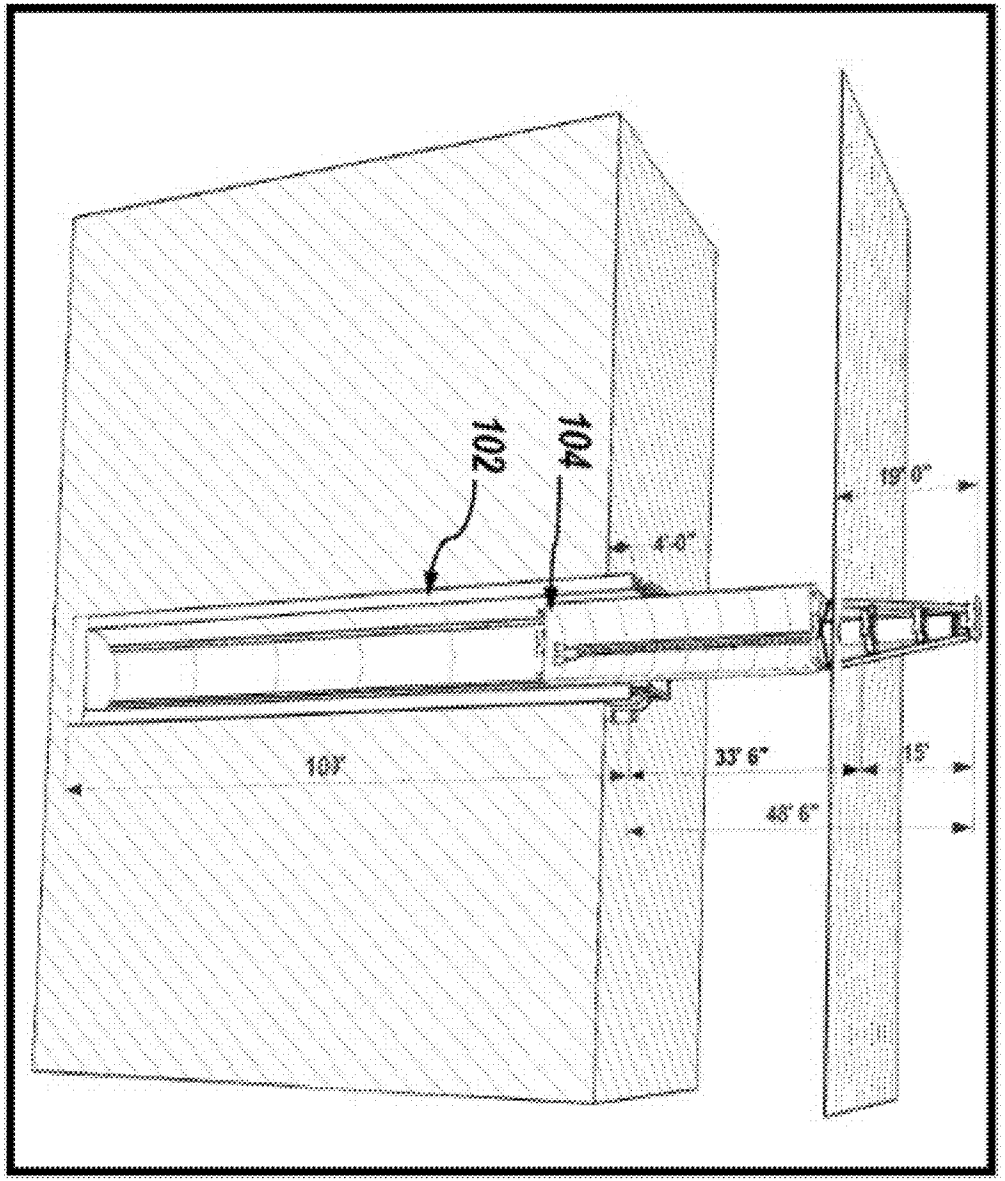
FIG. 10 shows the buoyant sponson tank extending from within the sponson well to supply a buoyant force against a supported structure based on the second water level, in accordance with an embodiment of the present disclosure.

FIG. 10 shows the buoyant sponson tank of the lift system in FIG. 9 rising at the same rate the water level changes around it, when subjected for example to 33'-6" deep floodwater the system will raise 33'-6" while maintaining the 19'-0" clearance Shown in FIG. 9 between the water surface and the underside of the structure the foundation system supports, if the ballast water level in the sponson tank remains at the same level as shown in FIG. 9, which in both figures is fully discharged.

The bore of the sponson well 102 preferably includes a sheet pile lining 106 that at least partially surrounds the bore. The sheet pile lining 106 can comprise, for example, steel, galvanized steel or core 10 steel or other suitable metal/metal alloy. In some cases the sheet piling serves primarily as a temporary soil retention system during construction and in the case of conventional non-plated or otherwise corrosion protected steel, can be sacrificed to corrosion without negatively impacting the system once the concrete infill 110 is poured. Where rock ledge, bedrock or coral of an appropriate density and stability are present the well can be drilled and not require sheet piling. In shallow water or on land, soldier piles and lagging or other means of soil retention can be employed instead of sheet piling.

The bore of the sponson well 102 preferably includes a shaft wall liner 108. The shaft wall liner 108 at least partially surrounds the bore. The shaft wall liner 108 preferably includes a substantially cylindrical shape and is configured to be received within a cavity defined by the sheet pile lining 106. The shaft wall liner 108 may also be referred to herein as a cylindrical shaft wall liner.

The shaft wall liner 108 preferably comprises a cylindrical Fiber Reinforced Polymer, although other materials such as concrete and precast concrete (e.g., concrete pipe generally available in diameters up to 12.5' diameter), precast concrete box culvert or corrosion resistant metal such as corrugated metal pipe which can be manufactured in diameters between 6" and 150" in any length or very large diameter systems can use corrugated metal multi-lane roadway tunnel liners and storage tanks or steel shaft casing and liners that are assembled in multiple curved sections or glass fused bolted steel tanks are suitable for use.

The bore of the sponson well 102 further preferably includes at least one layer of concrete 110 disposed between the sheet pile lining 106 and the shaft wall liner 108 to reinforce the cylindrical shaft wall liner. The at least one layer of concrete 110 further preferably provides a footing 111, at the base of the bore of the sponson well 102.

The concrete 110 may also include steel reinforcing preferably in the form of construction industry standard steel, or plated and/or otherwise corrosion protected steel or stainless steel reinforcing bar. Such reinforcing structures can be fabricated in place inside the well with water being pumped out. Such reinforcing structure can also be fabricated off-site or on-site on land or on a floating deck or barge as a cage-like structure comprised of vertical and horizontal reinforcing bars which are commonly referred to as "rebars". When the rebar structure is fabricated it can be lowered into the well with a crane even when the well is partially flooded or completely submerged below a water body. After the reinforcing is secured in the well, concrete can be poured even if the tunnel is flooded or completely underwater using a watertight concrete pouring pipe and conical shaped hopper system commonly known as a Tremie system. The advantage these construction processes offer is the ability to construct the entire (or substantially the entire) floating foundation system in conditions where groundwater is present or the entire system is completely submerged under a body of water without having to dam or pump the water out of the construction site.

The bore of the sponson well 102 further preferably includes at least one metal channel guide track 112 mounted to the cylindrical shaft wall liner, the at least one metal channel guide track extending along the longitudinal axis of the sponson well 102.

The sponson well 102 further preferably includes a mesh 114, which may also be referred to herein as a screen. The mesh 114 can be configured to reduce ingress of debris into the bore of the sponson well 102 while allowing water to flow through it at a rate that is greater than or equal to the flow rate that can be achieved via the space between the sponson and the well 102. Simply stated, the mesh 114 preferably does not obstruct the rate of water flow so that the system can raise and lower at a rate that accommodates the fastest water level change/rate the system is designed to handle.

The screen 114 in the case of a cylindrical well 102 can be square shaped in plan or substantially cylindrical and can also be designed to extend in length by several configurations including using an accordion/extendable frame or be constructed as a series of screens of different widths that can form a friction fit when disposed within each other. One preferred approach for an accordion/extendable frame design can be similar to rectilinear or cylindrical shaped collapsible fish net traps that have a continuous flexible helix/spiral shaped rod integrated into the netting that serves as a structure to control the shape of the system.

Houseware products such as laundry hampers and childrens' collapsible tunnel play structures that children crawl through employ a similar approach except fabric or mesh is used instead of netting. Both of these design approaches can be scaled to create a reinforced collapsible debris protection system that is a rectilinear or cylindrical shape. The continuous helix shaped reinforcing structure can be made from a variety of materials including anti-corrosion plated and/or coated steel or spring steel. If the lift system requires protection from small size debris or silt, the netting can be replaced with, or include a layer of numerous types of flexible screen, mesh or filter fabric.

The sponson well 102 can extend higher than the adjacent land or seabed enough to compensate for future soil, silt and sand or other debris such as plant and tree leaves or aquatic plant material or ice and snow that might accumulate on the ground or on the river, lake or sea bed around the well during flooding or other conditions that cause this material to build up. Although the extension of the sponson well shaft 102 above the seabed is dimensioned as four feet in height on the left side of the sponson well 102 in FIGS. 1, 4, 5, and 6, it can be greater or less than the four foot height if specific site conditions warrant a different height. The sponson well 102 further preferably provides pipe 116. The pipe 116 further preferably defines a fluid passageway to allow for water on the surface of the area surrounding the sponson well 102 to be communicated/provided within the bore, and more particularly, within the interior of the shaft wall liner 108 to displace the buoyant sponson tank 104, as discussed in greater detail below. To this end, the fluid passageway of the pipe 116 can include an inlet that is adjacent/proximate the surface (e.g., the area adjacent the top of the sponson well 102) and an outlet that is within the bore of the sponson well 102. The fluid passageway 116 can also include a screen and/or filter to keep debris from entering the system. The fluid passageway filtration system can also include an agitator or air bubbler to move debris away from the filter or reduce the formation of ice in the water around the filter.

Ice formation can also be reduced in and around the entire lift system by installing an air bubbler or other mechanisms used to keep ice from forming around hulls of watercraft that are docked in areas with subfreezing temperatures.

The buoyant sponson tank 104 preferably includes a sponson tank 118, and can have two or more tanks configured one above another or side-by-side in single sponson well 102 which may also be referred to herein as a ballast tank or simply a tank. The sponson tank 118 is preferably configured to be displaced by a volume of fluid that is external to the sponson tank such that the buoyant sponson tank 104 provides a predetermined buoyant force against the supported structure (not shown) by way of the exoskeleton superstructure 105 to cause the supported structure to be displaced vertically.

The sponson tank 118 further preferably includes an elongated body that extends from a first end to a second end. More preferably, the sponson tank 118 includes a substantially cylindrical profile, such as shown in FIG. 1.

The sponson tank 118 is preferably formed of materials such as metal including aluminum, galvanized steel including corrugated steel, glass fused to steel (GFS) or stainless steel with corrosion resistant coatings or with a fiberglass overlay and more preferably Fiberglass-Reinforced Polyester, Fiberglass, Fiberglass-Reinforced Plastic (FRP) or Glass Fiber Reinforced Plastics (GRP) composite materials made of a polymer matrix reinforced with fibers that will provide the best resistance to decay in water or salt water conditions because of their inherent corrosion resistant properties or other suitably ridged material. All of these materials can be designed with appropriate wall thicknesses and end caps to handle 4 Atms or more of atmospheric pressure.

The sponson tank 118 preferably includes an overall length that is not greater than six times the tank diameter to ensure structural integrity. The sponson tank 118 preferably includes an overall height of between 10 and 100 feet, and more preferably at least 30 feet. The sponson tank 118 also further preferably includes a diameter of between 6 inches and 30 feet, and more preferably at least 8 to 12 feet and can be greater than 30 feet. The provided examples are not intended to be limiting. See Table 1 in FIG. 12 for other heights and diameter configurations of the sponson tank 118.

The sponson tank 118 is preferably configured to be water tight and can contain air (or other gas), or preferably, air and a predetermined amount of ballast fluid 120, such as water. One or more pumps 122, such as Siamese pumps as shown or other submergible pumps, are preferably disposed within the sponson tank 118 and are configured to selectively adjust the amount of ballast fluid 120 within the sponson tank 118.

Notably, the one or more pumps 122 can be configured to communicate ballast fluid 120 external to the sponson tank 118 within the sponson well 102 to cause the buoyant sponson tank to be displaced, e.g., by buoyant force, to cause the same to vertically rise and select a desired height for a supported structure (not shown). Additional aspects of this feature are disclosed below with regard to FIGS. 4 and 6.

The exoskeleton superstructure 105 preferably encompasses the sponson tank 118 and serves to transfer loading forces, particularly lateral loading forces to increase the load carrying ability of the sponson to transfer lateral loads from the structure the system carries and transfer them via outer frame member(s) 130 to the sponson well structure 102 and into the ground surrounding the well 102. The exoskeleton superstructure preferably extends from the top end of the sponson tank 118 such that the exoskeleton superstructure 105 and sponson tank 118 are axially aligned. The exoskeleton superstructure 105 further preferably provides a platform 107 that extends from the sponson well 102 that is configured to transfer a load of a structure disposed thereon to the sponson tank 118.

The exoskeleton superstructure 105 further preferably comprises a metal frame, the metal frame having a conical shape based on a plurality of elongated support members that extend from the sponson tank 118 to the platform 107. The metal frame of the exoskeleton superstructure 105 can comprise, for example, anti-corrosion plated and/or coated steel.

The exoskeleton superstructure 105 including platform 107 may be more broadly understood as a mechanical assembly with structural components (e.g. metallic beams and/or metallic tubing providing a metal frame) that serves to transfer the load bearing ability of the sponson to lift a structure that needs lifting. Accordingly, the exoskeleton superstructure 105 including a load bearing assembly 107 to transfer the load bearing ability of the structure that needs lifting to the exoskeleton superstructure 105, as illustrated, represents only one preferred configuration for a mechanical assembly that is positioned on the top of the sponson to, as noted, engage with the structure to be lifted. In addition, it may be appreciated that the mechanical assembly that extends from the sponson tank may be understood to also transfer the load of the structure to the sponson tank, where such load may then require lifting.

The buoyant sponson tank 104 further preferably comprises an access tower 124 extending from an end of the sponson tank 118 of the buoyant sponson tank 104. The access tower 124 can include a substantially cylindrical body with a water tight access hatch 126 at an end adjacent the platform 107 of the exoskeleton superstructure 105. The access tower 124 preferably extends between the plurality of elongated support members of the exoskeleton superstructure 105, although this disclosure is not limited in this regard.

The buoyant sponson tank 104 further preferably includes a ladder 125 (See FIG. 3) disposed within the access tower and/or on an external surface of the access tower.

The sponson tank 118 of the buoyant sponson tank 104 further includes at least one outer frame member 130 (See FIG. 3) configure to engage the at least one metal channel guide track 112 such that movement of the sponson tank 118 is confined to a vertical axis that extends substantially parallel with the longitudinal axis of the sponson well 102. Thus, the predetermined buoyant force provided by the buoyant sponson tank 104 is supplied to a supported structure along a direction that extends along the vertical axis/longitudinal axis of the sponson well 102.

Table 1, as shown in FIG. 8, enumerates various example system size configurations, e.g., the number of buoyant sponson tanks, well bore sizes, tank diameters, tank heights, and a resulting displacement force (in tons), also referred to herein as a predetermined buoyant force.

FIG. 1 specifically illustrates the buoyant sponson tank in a fully retracted position (or a first position) during astronomical low tide, e.g., calm sea conditions at 2.5' (0.75M) above mean low tide. In one preferred example, the sponson tank 118 of the buoyant sponson tank measures 12'ø×40' (3.7Mø×12M), has a 4,472 cubic foot (127 cubic meter) size tank, and can be filled partially with water ballast (or other suitable fluid, gas, or both) to position the first floor level of supported structure as close to the ocean surface as is desired/practical. One such example includes within 2 feet of the surface of the surrounding water.

Wave motion Sensors in the immediately vicinity of the system and remotely located on buoys in adjacent harbors and ocean waters combined with other state, national or international emergency warning systems can provide data that the lift system 100 can use to continuously monitor ballast weight and determine what minimum height the system needs to maintain. Such adjustments may be performed by a processor (not shown) which is local to the lift system 100, for example.

Figure 4:
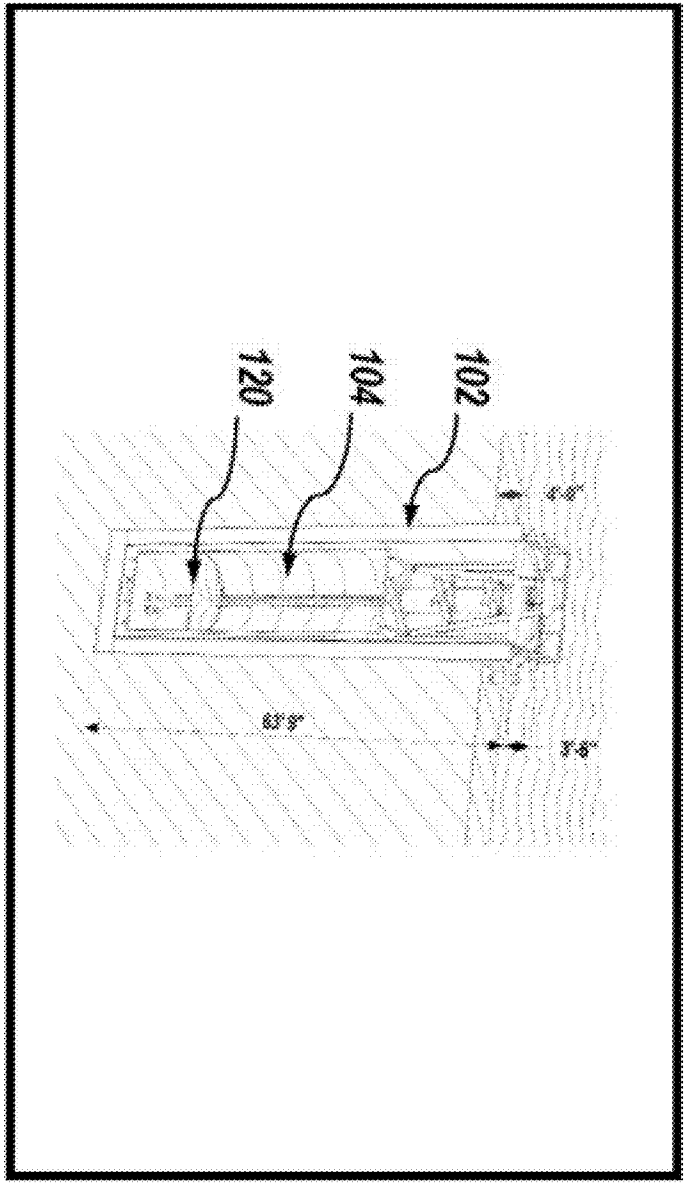
FIG. 4 shows an example of the buoyant sponson tank in its lowest position floating within the sponson well of FIG. 2 to supply a buoyant force against a supported structure based on a first water level, in accordance with an embodiment of the present disclosure.

FIG. 4 shows an example of the buoyant sponson tank 104 extending from within the sponson well of FIG. 2 to supply a buoyant force against a supported structure (not shown) based on a first water level. In this example, the first water level is 15 feet.

In this example, the buoyant sponson tank 104 is in its retracted, low tide position during rough sea conditions. With ballast water pumped out of the sponson tank the lift system 100 preferably raises the supported structure (not shown) above 17.5' (5.3M) higher than the mean water surface. The sponson tank can be partially or fully emptied via submersible pumps set at the bottom of the sponson tank, as discussed above.

Completely emptied of ballast water, the lift system 100 can raise the first floor level of the structure it supports an additional 15' (4.5M) higher than the lowest position of 2.5' (0.75M). This raises the first floor level 17.5' (5.3M) above the ocean surface.

Figure 5:
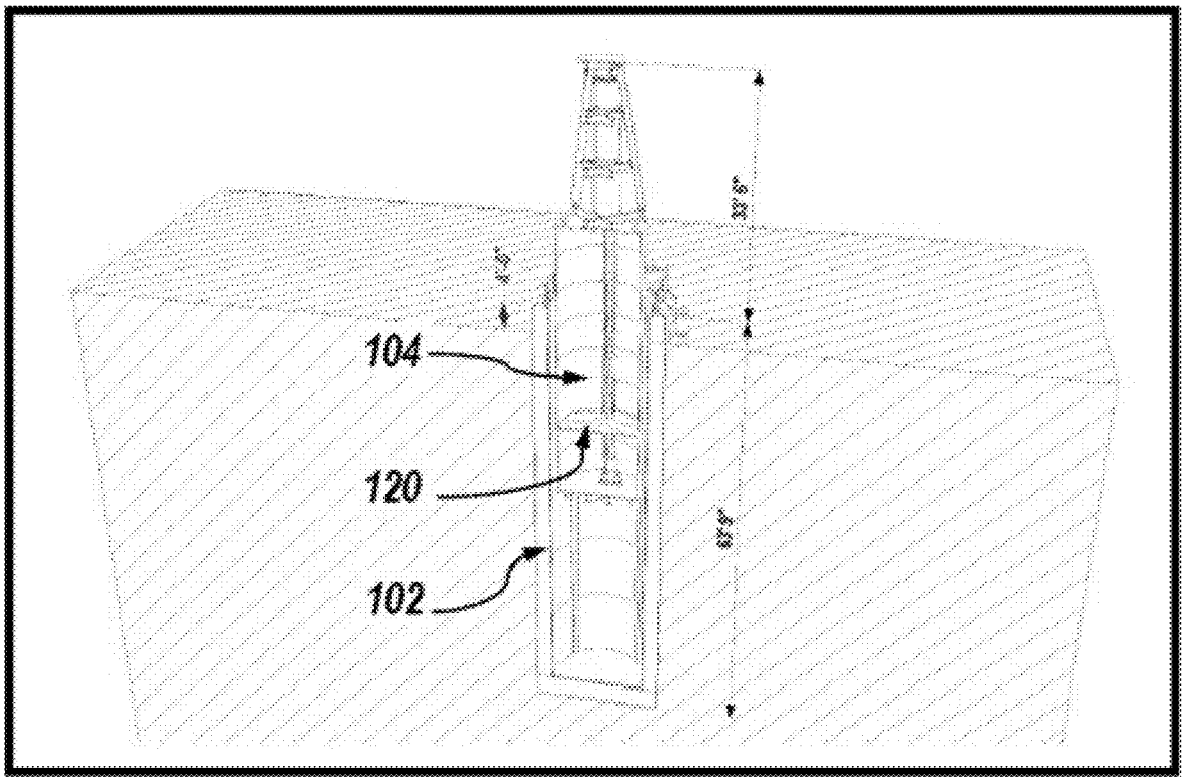
FIG. 5 shows the buoyant sponson tank extending from within the sponson well of FIG. 2 to supply a buoyant force against a supported structure based on a second water level, in accordance with an embodiment of the present disclosure.

The pair of pumps can run in reverse to refill the sponson tank with sea water to lower the supported structure's height above water as the seas calm down FIG. 5 shows the buoyant sponson tank 104 extending from within the sponson well of FIG. 2 to supply a buoyant force against a supported structure based on a second water level. In this example, the water level is 33 feet, 6 inches.

In this example, the buoyant sponson tank 104 rises at the same rate as ocean levels rise. FIG. 5 shows the buoyant sponson tank responding to a 30' (9M) storm surge or Tsunami to a position that is 33.5' (10M) above mean low tide. Hurricane Dorian in September 2019, generated a 23 foot (7M) high storm surge on Grand Bahama Island.

Figure 6:
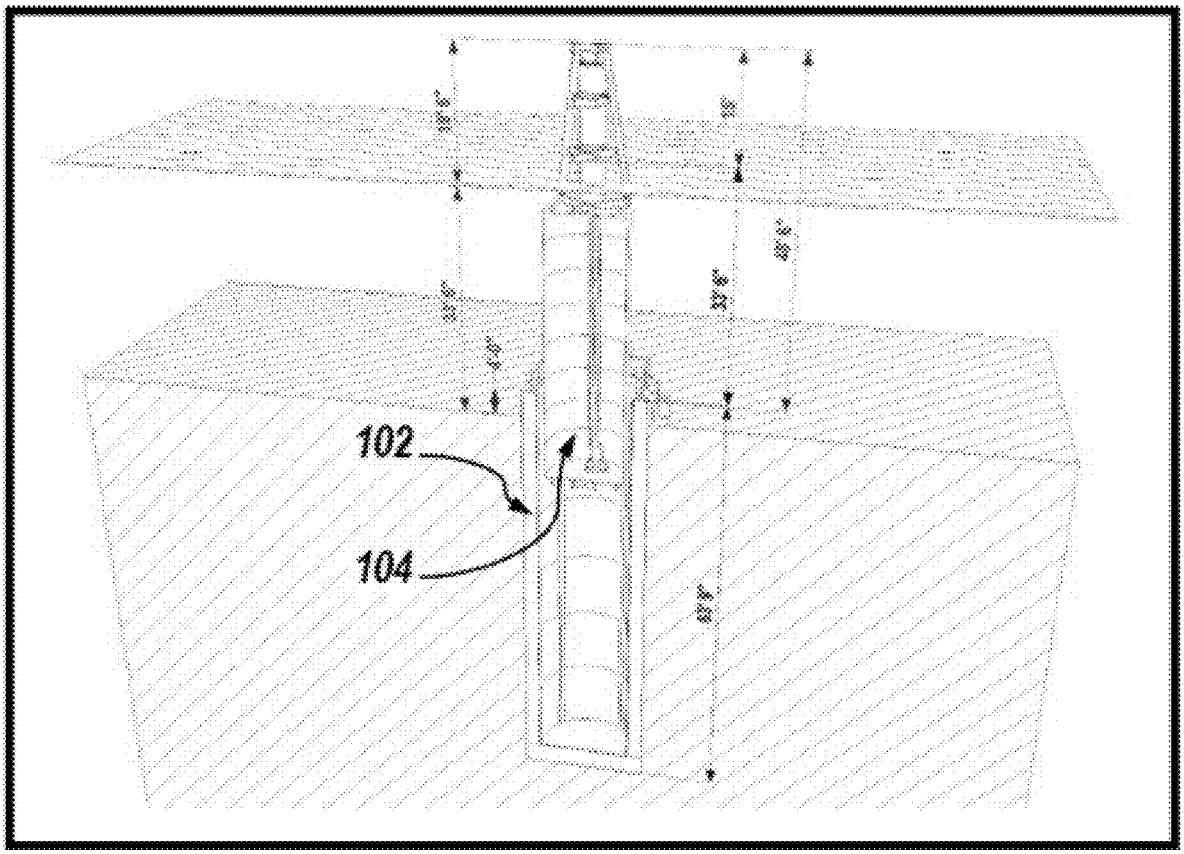
FIG. 6 shows the buoyant sponson tank extending from within the sponson well of FIG. 2 to supply a buoyant force against a supported structure based on the second water level, in accordance with an embodiment of the present disclosure. Ballast water 120 shown in FIG. 5 has been discharged in FIG. 6 to decrease displacement of the system and raise the structure the system supports higher relative to the water surface height.

FIG. 6 shows the buoyant sponson tank extending from within the sponson well of FIG. 2 to supply a buoyant force against a supported structure based on the second water level. In this example, the buoyant sponson tank 104 is extended from the sponson well 102 to a highest position at ~50' (14.75M) above mean low tide. In this preferred example, water pumped from sponson tank adds 15' (4.5M) of additional height to compensate for rough ocean surface conditions to position the structure 48.5' (14.75M) higher than the base low tide position.

Utility lines for potable water and sewage can be similar to those used on houseboats where tides raise and lower the home twice per day except they may be designed to allow for significantly more travel up and down. These lines can also incorporate breakaway connections that when the system 100 lifts a structure beyond a certain height the connection lines automatically break apart. It is contemplated that connections lines or hoses of various diameters can be used that are similar to compressed air hoses used on railroad cars. Air hoses between railroad cars simply twist a partial turn when mated together by railroad crew to make a robust, secure air tight connection. When railroad cars uncouple, the tension on the air hose caused by the train cars separating pulls against the connection between the hoses, exerting a twisting force on the air hose connection as tension increases. This force twists the hose connection in the opposite direction it was coupled and detaches it with no man intervention. Electrical connections can be handled with spring loaded self coiling cables that have a connector similar to Head End Power (HEP) plug connectors used on passenger trains in the US.

Figure 11:
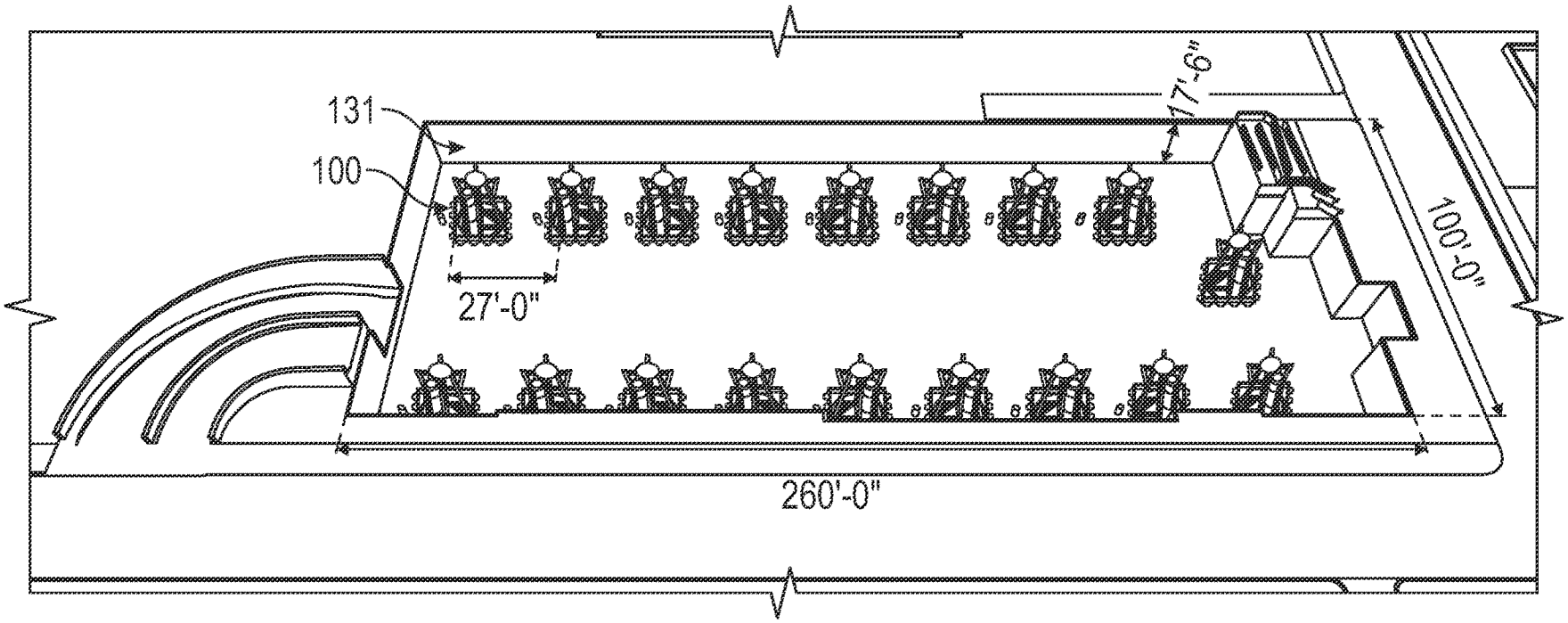
FIG. 11 shows that establishing the top of the sponson well structure height below the height of the surrounding grade within a below grade recess, recessed foundation system or basin system has many advantages including the ability to raise subterranean elements included with above grade structures the system supports, such as a basement level above grade or raising fully below grade, subterranean structures commonly referred to as underground structures to be fully above grade. The remaining void in the ground left behind by raising the structure the system supports, can serve additional purposes. One purpose of the void is for use as a stormwater capture and retention basin to add capacity to municipal storm sewer systems.
Figure 13:
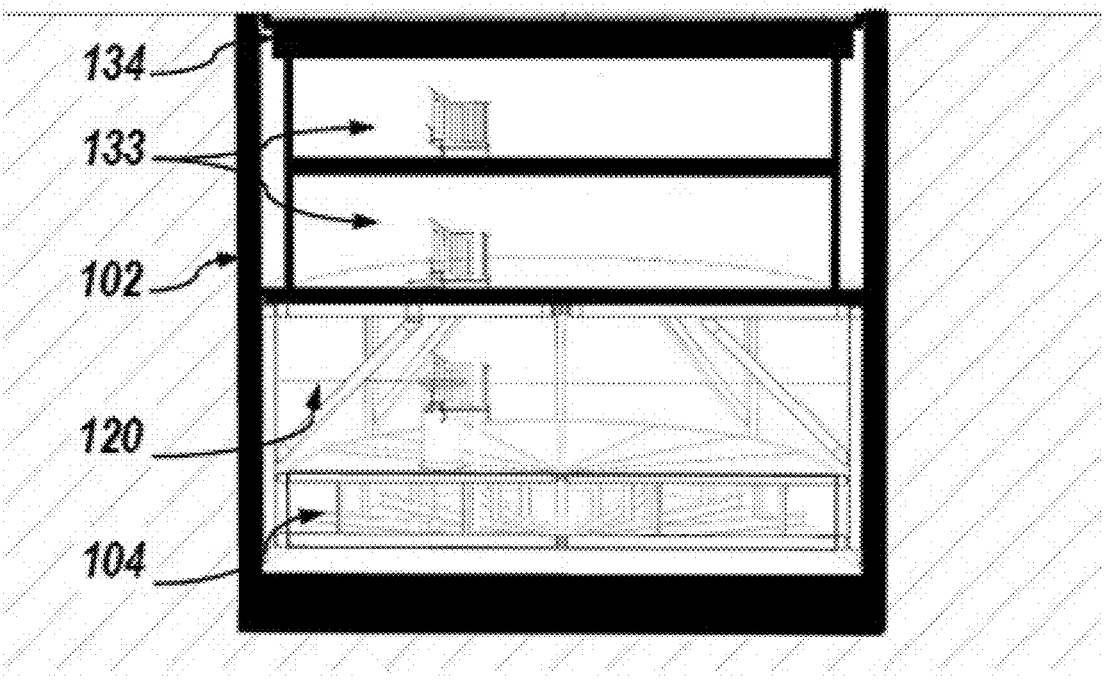
FIG. 13 shows a lifting pad foundation system, in accordance with an embodiment of the present disclosure that has a sponson well 102 that is 50' in diameter and 45' deep that is similar in design as lift system 101 in FIG. 8, located on upland where flooding happens occasionally except it can support a 3,000 sq ft. two-story building 133 with a flat roof 134 and lift the building above grade and completely below grade to stow the two-story building within the sponson well structure as shown in the 2D cross-sectional view FIG. 13.
Figure 14:
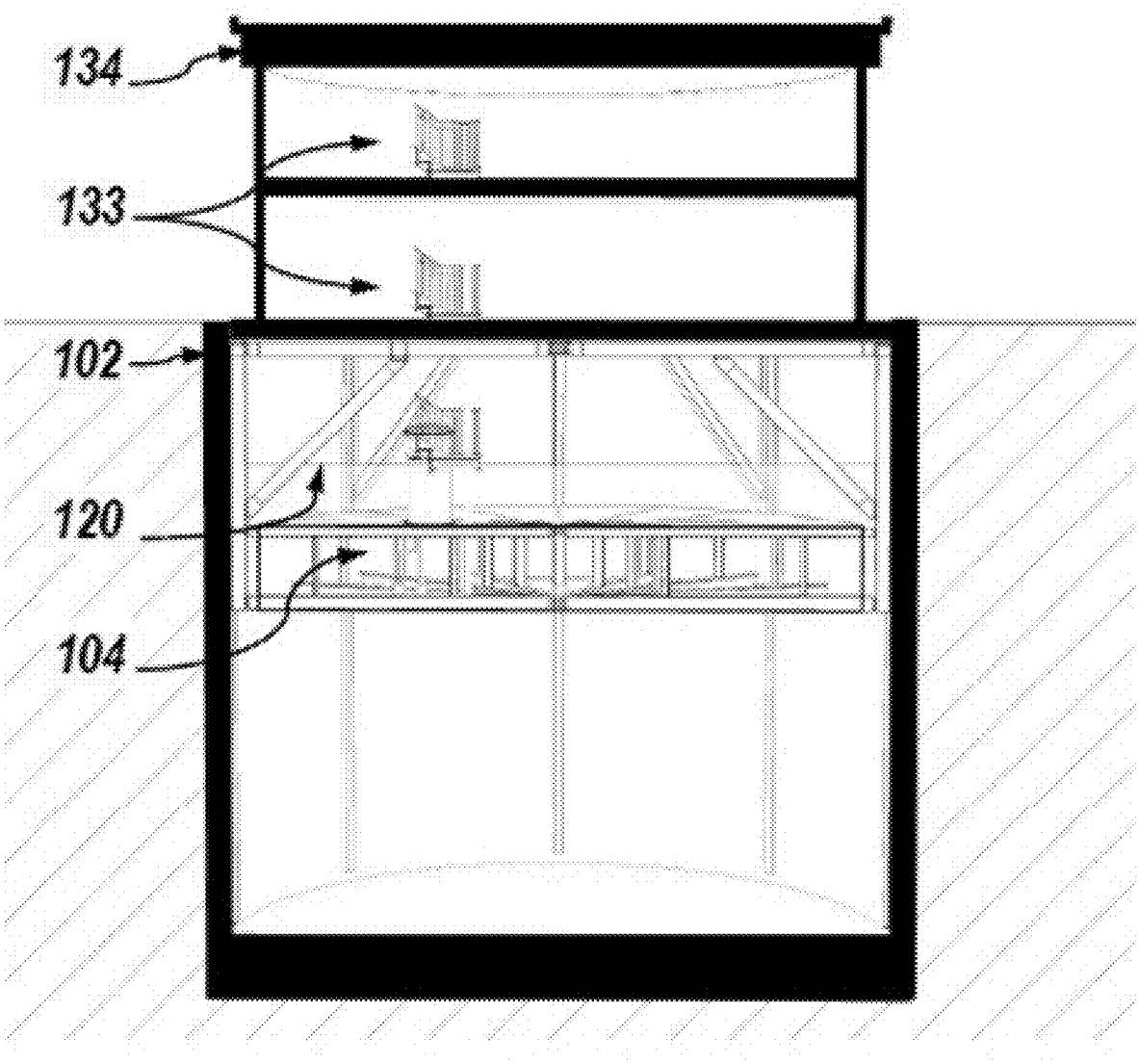
FIG. 14 shows the same foundation system and building shown in FIG. 13 except with the building raised so the first-floor level of the two-story building aligns with the finish grade adjacent to the structure.

It may now be appreciated that the height of the top of the sponson well structure can be at virtually any height above or below the adjacent site grade elevation. FIG. 11 demonstrates that establishing the top of the sponson well structure height below grade has many advantages including the ability to raise subterranean elements of above grade structures the system supports above grade or the same could be accomplished with fully below grade, subterranean structures commonly referred to as underground structures. In FIG. 11, the system may preferably support a multi-story building that includes an underground parking garage which is not shown in the image to provide a better view of the foundation system. To scale the lift system for such an application, the lift system dimensions can be increased or multiple lift systems can be combined and function together in unison as shown in FIG. 11, where eighteen of the lift systems 101 shown in FIGS. 7-9, are arranged to float and lift, for example, a 100,000 sq ft. multi-story building that includes a full basement level underground parking garage. The eighteen lift systems are shown with enough ballast water discharged from the sponson tanks to lift the building enough to position the lowest part of the basement garage structure which is normally completely underground, to be higher than the street level sidewalk grade. The 17'-6" deep void in the ground where the parking garage stows when flooding is not present, is surrounded by an industry standard conventionally constructed reinforced cast-in-place concrete perimeter foundation wall and floor slab system 131 that is integrated with the eighteen cast-in-place concrete sponson wells 101 in FIG. 9. with steel reinforcing bars, bulb type waterstops in cold joints of the concrete and waterproof coatings or membranes as are typically used in this type of construction. Because the perimeter foundation system is waterproof and keeps groundwater from infiltrating the space within it, it can serve additional functions as a stormwater capture and retention basin or if design appropriately, a stormwater recharge basin when the building is raised.

Most municipalities do not have adequate stormwater management systems to address potential increased flood risk anticipated with storms and king tide flooding associated with global warming predictions. A basin with the footprint shown in FIG. 11 filled 17'-0" deep, would retain 3,300,000 gallons of stormwater. If the same footprint were deep enough for a two-story level underground parking garage and the garage was lifted using the same lifting system, the basin filled to the same height would retain over 5 million gallons of stormwater. Sunny day or king tide flooding that overwhelms storm sewer systems and floods neighborhoods in many cities today could be prevented over an area many city blocks in size by stormwater capture at the scale of 3 million gallons or more. In the Fall of 2020, US Federal Emergency Management Agency regulations went into effect across the United States that preclude having habitable space or vehicle parking near to or below predicted high water level, base flood elevation heights. If the foundation lift system and basin were funded by a municipality perhaps by the use of municipal bonds, the municipality could repay the debt and realize a return on investment by revenue generated from future real estate taxes on the basement and first floor levels that would otherwise be unusable and untaxable. Property owners and/or real estate developers would realize greater profit potential by not having to pay for the building foundation, having basement and first floor levels that can be leased or sold and not having to pay flood insurance that for a building of this size located in, for example, a city like Boston, Mass. could be $300,000 or more annually.

Lift systems larger than the ones listed in FIG. 12 are possible and virtually no limits exist to the size of the overall dimensions lift systems can accommodate. For example, a lift system that is 50' diameter or a similar sq ft. area rectangle or free-form shaped footprint that is 45' or greater depth and includes all the same components and systems, proportionally scaled, that lift systems 101 and/or 101 include, could be categorized or named with the same conventions or preferably, these larger systems that include a monolithic slab or pad that payloads or structures of many different types can be built upon can be categorized as lifting pad systems.

The sponson tanks for lifting pad systems can be fabricated from a number of different materials including prefabricated off-the-shelf bolted Glass Fused to Steel (GFS) tanks typically used in industrial water, fuel and oil storage facilities.

For example, a lifting pad system of this size (50' diameter×45' depth) (shown in FIGS. 13 through 18) that is similar in design as lift system 101 in FIG. 8, located on upland where flooding happens occasionally, can support a 3,000 sq ft. two-story building 133 with a flat roof 134. In this configuration, the entire structure being carried on the lifting pad system could be raised above grade by removing/pumping ballast water out of the sponson tank 104 or into the sponson well in a similar way that system 101 works and the facility in FIG. 11 functions to protect against flooding. In addition to the lifting capability, the lifting pad system can also retract the entire 2 story building 134 to be completely below grade by adding/pumping ballast water into the sponson tank 104 and/or removing water from the sponson well 102.

Water can be added and removed from the sponson well independently from exchanging water with the sponson tank by pumping water to and from an adjacent or nearby water body or ideally a dedicated retention basin, or storage tank in order to create a closed loop system where water can be added and subtracted multiple times to the lift system by internal or external pumps or other means to raise and lower the lift system without introducing additional water into the system which may not be available if the system is in an arid or desert climate where water is scarce.

The flat roof 134 could be constructed with cast-in-place concrete slab or similar non-flammable dense materials with a thickness great enough to make the roof assembly fireproof and/or impact and explosion proof or the roof could meet this performance criteria by having soil or another non-flammable, relatively dense non-structural fill added on top of the roof. With this type of roof assembly and potentially adding a gasket of an appropriate material and/or an intumescent expansion seal between the edge of the flat roof 134 and the face of the sponson well, when the building is retracted it can become a fortress that is completely protected against surface fires, forest fires, sandstorm, tornado and hurricane force winds and flying debris, natural and manmade disasters including crashing land vehicles and aircraft, acts of war with missile or bomb strikes or virtually any off-site threat. This type of facility is ideal for military or civilian purposes including critical infrastructure elements such as public safety (fire and police stations), emergency management and emergency response facilities, 911 call centers, aircraft control and forest fire management stations and tower structures, Coastguard stations, etc. All of these facilities are essential for maintaining public safety and governance before, during and after disasters occur and could take many months of time to rebuild and get back on line if destroyed.

For military purposes or areas where buildings or other infrastructure elements are preferred to be hidden from view, if soil appropriate for planting is placed to an adequate depth on the roof of the structure, the roof could be planted with any type of plantings including mature trees so that when the facility is retracted below grade and the finish grade of soil on the roof aligns with the finish grade around the perimeter of the sponson well the roof of the building can exactly match the immediate surroundings. This approach can make the building virtually disappear from view. It can turn an unwanted multi-story height infrastructure element into an at grade level garden or park that creates a carbon offset and a usable public amenity instead of unwanted eyesore. Many emergency management centers are in underground facilities which would be more desirable to work in during non-emergency times if they could be lifted above grade and include lots of windows in the exterior walls to allow natural light and ventilation into the building and the roofs of these facilities function as roof gardens when they are raised.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. It will be appreciated by a person skilled in the art that an apparatus may embody any one or more of the features contained herein and that the features may be used in any particular combination or sub-combination. Modifications and substitutions by one of ordinary skill in the art are considered to be within the scope of the present disclosure, which is not to be limited except by the claims.

What is claimed is:

1. A lift system for supporting a structure, the lift system comprising:

a sponson tank that extends from a first end to a second end;

a first sponson well having a bore with a predetermined width, the bore configured to receive the sponson tank;

a mechanical assembly extending from the second end of the sponson tank, the mechanical assembly to transfer a load of a structure disposed on the mechanical assembly to the sponson tank;

and wherein the sponson tank is configured to be displaced by a volume of fluid that is external to the sponson tank such that the sponson tank provides a predetermined buoyant force against the structure by way of the mechanical assembly to cause the structure to be displaced vertically; and further comprising at least a second buoyant sponson tank, the second buoyant sponson tank having an associated sponson well and being configured to supply a buoyant force substantially equal to the predetermined buoyant force provided by the first buoyant sponson tank.

2. The lift system of claim 1, wherein the bore of the first sponson well includes a sheet pile lining.

3. The lift system of claim 1, wherein the bore of the first sponson well includes a cylindrical shaft wall liner disposed within a cavity defined by the sheet pile lining.

4. The lift system of claim 3, wherein the cylindrical shaft wall comprises a cylindrical fiber reinforced polymer liner.

5. The lift system of claim 4, further comprising a layer of concrete disposed within the first sponson well between the sheet pile lining and the cylindrical shaft wall liner to reinforce the cylindrical shaft wall liner.

6. The lift system of claim 3, further comprising at least one metal channel guide track mounted to the cylindrical shaft wall liner, the at least one metal channel guide track extending along a longitudinal axis of the first sponson well.

7. The lift system of claim 6, wherein the sponson tank of the first sponson well includes an outer frame member configure to engage the at least one metal channel guide track such that movement of the sponson tank is confined to a vertical axis that extends substantially parallel with the longitudinal axis of the first sponson well.

8. The lift system of claim 7, wherein the predetermined buoyant force provided by the sponson tank is supplied to the structure along a direction that extends along the vertical axis.

9. The lift system of claim 1, wherein the volume of fluid that is external to the sponson tank is received via a fluid passageway defined by the first sponson well.

10. The lift system of claim 9, wherein the volume of fluid comprises water, and wherein the fluid passageway of the first sponson well includes an inlet configured to receive the water from outside of the sponson well and an outlet to provide the water within the sponson well to cause the sponson tank to provide the predetermined buoyant force against the structure.

11. The lift system of claim 10, wherein the volume of fluid that is external to the sponson tank is provided by a pump that communicates the volume of fluid from within the sponson tank.

12. The lift system of claim 1, wherein the mechanical assembly comprises a metal frame, the metal frame having a conical shape based on a plurality of elongate support members that extend from the sponson tank.

13. The lift system of claim 1, further comprising an access tower extending from the second end of the sponson tank of the sponson tank, the access tower including a substantially cylindrical body with a water tight access hatch.

14. The lift system of claim 13, further comprising a ladder disposed within the access tower and/or on an external surface of the access tower.

15. The lift system of claim 1 wherein said sponson tank is configured to contain ballast to either increase or decrease the predetermined buoyant force against the structure to be displaced vertically.

* * * * *